US008286807B2

(12) United States Patent
Winnard

(10) Patent No.: US 8,286,807 B2
(45) Date of Patent: Oct. 16, 2012

(54) SLIDABLE TOOL HOLDER

(76) Inventor: Stanley D. Winnard, Carrollton, TX (US)

( * ) Notice: Subject to any disclaimer, the term of this patent is extended or adjusted under 35 U.S.C. 154(b) by 269 days.

(21) Appl. No.: 12/391,081

(22) Filed: Feb. 23, 2009

(65) Prior Publication Data

US 2009/0218302 A1 Sep. 3, 2009

Related U.S. Application Data

(60) Provisional application No. 61/030,954, filed on Feb. 23, 2008.

(51) Int. Cl.
*A47F 7/00* (2006.01)

(52) U.S. Cl. ..... 211/70.6

(58) Field of Classification Search ..... 211/70.6, 211/69, 60.1, 69.1, 120, 89.01, 183; 206/376, 206/480, 481, 482, 477, 478, 3, 372, 373, 206/377, 378

See application file for complete search history.

(56) References Cited

U.S. PATENT DOCUMENTS

| | | | | |
|---|---|---|---|---|
| 4,310,094 | A * | 1/1982 | Hotchkiss, Jr. | 211/70.6 |
| 5,036,975 | A * | 8/1991 | Chow | 206/376 |
| 5,598,924 | A * | 2/1997 | McCann | 206/372 |
| 5,659,440 | A * | 8/1997 | Acosta et al. | 360/92.1 |
| 5,730,303 | A | 3/1998 | Chow | |
| 5,931,299 | A | 8/1999 | Hsieh | |
| 5,967,340 | A * | 10/1999 | Kao | 211/70.6 |
| 6,079,559 | A * | 6/2000 | Lee | 206/378 |
| 6,092,656 | A * | 7/2000 | Ernst | 206/378 |
| 6,315,121 | B1 | 11/2001 | Hansen | |
| 6,386,363 | B1 * | 5/2002 | Huang | 206/378 |
| 6,536,611 | B2 * | 3/2003 | Chen | 211/70.6 |
| 6,698,600 | B1 * | 3/2004 | Lee | 211/70.6 |
| 6,758,350 | B2 | 7/2004 | Lin | |
| 6,827,210 | B2 | 12/2004 | Chen | |
| 6,896,136 | B2 * | 5/2005 | Hu | 206/378 |
| 6,976,582 | B2 | 12/2005 | Chen | |
| 7,055,689 | B2 * | 6/2006 | Chen | 206/376 |
| 7,066,339 | B2 * | 6/2006 | Chiu et al. | 211/70.6 |
| 7,178,670 | B2 * | 2/2007 | Chen | 206/376 |
| 7,441,669 | B1 * | 10/2008 | Dalbey | 211/85.7 |
| 7,584,845 | B2 * | 9/2009 | Cheng | 206/376 |
| 7,757,867 | B2 * | 7/2010 | Hsieh | 211/70.6 |
| 7,815,058 | B2 * | 10/2010 | Cheng | 211/70.6 |
| 2001/0010291 | A1 * | 8/2001 | Hu | 206/377 |
| 2003/0024837 | A1 * | 2/2003 | Chen | 206/378 |
| 2005/0173279 | A1 * | 8/2005 | Chen | 206/372 |
| 2006/0207951 | A1 * | 9/2006 | Wang | 211/70.6 |
| 2007/0023369 | A1 * | 2/2007 | Lin | 211/70.6 |
| 2008/0128370 | A1 * | 6/2008 | Shih | 211/70.6 |
| 2009/0218302 | A1 * | 9/2009 | Winnard | 211/70.6 |
| 2010/0065522 | A1 * | 3/2010 | Cheng | 211/85.8 |

* cited by examiner

*Primary Examiner* — Jennifer E. Novosad

(57) ABSTRACT

The present invention includes an apparatus and method for restraining a tool that includes a base with at least one first restraint extending from the base and at least one second movable restraint extending from the base to slidably engage a tool disposed between the first restraint and the second movable restraint.

21 Claims, 10 Drawing Sheets

SLIDABLE TOOL HOLDER

CROSS-REFERENCE TO RELATED APPLICATIONS

This application claims priority to U.S. Provisional Application Ser. No. 61/030,954, filed Feb. 23, 2008, the contents of which is incorporated by reference herein in its entirety.

TECHNICAL FIELD OF THE INVENTION

The present invention relates in general to the field of tool holders, and in particular, a process and apparatus for securing and holding tools of various sizes such that each tool is easily accessible and identifiable.

BACKGROUND OF THE INVENTION

Recently, there has been a growing desire throughout industry and do-it-yourselfers alike for an apparatus incorporating a method that allows for the more efficient storage and retrieval of tools. Until now, traditional tool holders satisfied end users by including predefined spaces in which individualized tools could either be snapped into or removed from, one at a time. However when multiple tools of unrelated dimensions need immediate containment, modern tool holders are disappointing.

Today, common tool holders, which need not account for gravity to perform, do so by providing compartments fitted for individualized tools, often marketed in carrying case form for such tools. While generalized tool holders can suffice, when immediate controlled storage and release of multiple tools becomes imminent, such devices neglect expediency. Moreover, though such holders might serve as decent tool restraints, their efficacy often suffers in environments of high portability due to continual dropping.

As a consequence of the foregoing, a longstanding need exists among users for a method and apparatus that allows for the quick, simple, and effective storage and retrieval of tools not subject to dimensional prerequisites.

SUMMARY OF THE INVENTION

In accordance with the present invention, an apparatus and method are provided to allow for the more efficient storage and retrieval of tools. The present invention provides a tool holder, made of a first base at least one first restraint, and at least a second base that is movable in relation to the first base having one or more second restraints, wherein the first and second restraints slide in relation to each other and engage and hold a tool between the first and the second restraints.

For example, a tool may be disposed between the tool holder's first restraints and second restraints, a second restraint may be slid towards a first restraint, and a tool may be engaged between the first restraint and the second restraint. In another example, tools of different sizes may be slidably engaged between one or more first restraints and one or more second restraints.

One embodiment of the present invention includes a tool holder having a first and a second base, with at least one first restraint extending from the first base, and at least one second movable restraint extending from a second base to slidably engage a tool disposed between the first restraint and the second restraint. In another embodiment, the first base may have two or more first restraints.

Furthermore, the first restraints may differ in size from other first restraints to engage differently sized tools. The second movable restraint slidably engages a tool disposed between the first restraints and the second movable restraint extending from the first or second bases with two or more first restraints. Also, additional first restraints of differing sizes may be placed along the base member and may engage tools of differing sizes with the second movable restraints of the second base.

In some embodiments the first restraint and second restraints may be spaced apart from another. In other embodiments, the first, second or both restraints may be spaced apart from one another. As well, the first or second restraints may be aligned parallel to the longitudinal axis of the first or the second bases, while optionally spaced equidistantly or staggered in relation to one another. Another embodiment may allow the first or second restraints to extend substantially perpendicular to the first or second bases' horizontal axis or the first or second restraints may extend to form an angle with the first or second bases' horizontal axis between 30 degrees and 150 degrees. Other embodiments may include pads attached to the first, the second or both the first and second restraints. Still other embodiments may include one or more apertures extending through the vertical axis of the first or second bases for lockedly engaging tools within the tool holder.

Another embodiment of the present invention allows a user to prevent further movement of the first restraints and second restraints which have slidably engaged the tool by including one or more apertures, through which a locking mechanism may be rotated. The present invention also includes a method of using the tool holder including the steps of disposing a tool between the one or more first restraints and the one or more second restraints, each of which extending from a first and second base, respectively. The one or more first and second restraints may be slid towards the first or second restraints. The tool may then be constrained through friction upon engagement of the first and second restraints.

Furthermore, the present invention may be made such that the first restraints are metallic or non-metallic or magnetic or non-magnetic or elastomeric or non-elastomeric or malleable or non-malleable or the one or more second restraints are metallic or non-metallic or magnetic or non-magnetic or elastomeric or non-elastomeric or malleable or non-malleable. Also, the present invention may be made such that the base is metallic or non-metallic or magnetic or non-magnetic or elastomeric or non-elastomeric or malleable or non-malleable.

BRIEF DESCRIPTION OF THE DRAWINGS

For a more complete understanding of the features and advantages of the present invention, reference is now made to the detailed description of the invention along with the accompanying figures and in which.

DETAILED DESCRIPTION OF THE INVENTION

Figure 1C:
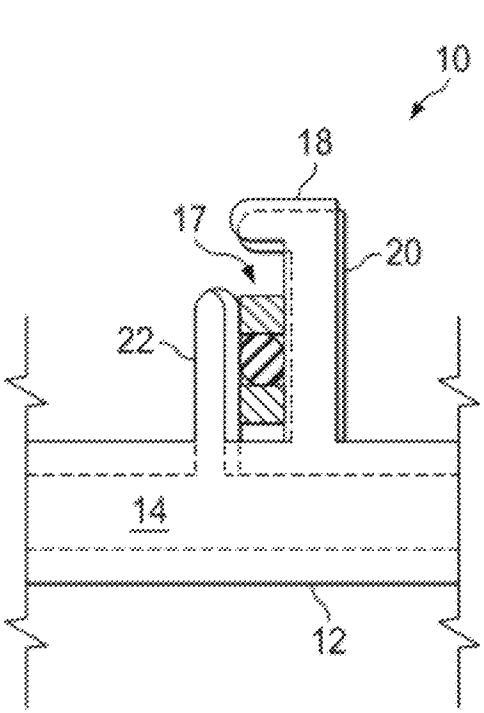
FIG. 1 illustrates three very rough cut-out side views of the base with first restraints being slidably engaged by a second restraint to hold a tool.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of this invention, a number of terms are defined below. Terms defined herein have meanings as commonly understood by a person of ordinary skill in the areas relevant to the present invention. Terms such as "a", "an" and "the" are not intended to refer to only a singular entity, but include the general class of which a specific example may be used for illustration. The terminology herein is used to describe specific embodiments of the invention, but their usage does not delimit the invention, except as outlined in the claims.

The tools and tool holder of the present invention may be made from a wide variety of materials that may include, e.g., metallic or non-metallic or magnetic or non-magnetic or elastomeric or non-elastomeric or malleable or non-malleable or the one or more second restraints are metallic or non-metallic or magnetic or non-magnetic or elastomeric or non-elastomeric or malleable or non-malleable. Also, the present invention may be made such that the base is metallic or non-metallic or magnetic or non-magnetic or elastomeric or non-elastomeric or malleable or non-malleable. Examples of materials include metals, plastics, polymers, wood, alloys, composites and the like. The metals may be made from one or more metals, such as steel, stainless steel, aluminum, titanium, nickel, magnesium, or any other structural metal. Examples of plastics or polymers may include: nylon, polyethylene (PE), polypropylene (PP), polyester (PE), polytetraflouroethylene (PTFE), acrylonitrile butadiene styrene (ABS), polyvinylchloride (PVC), or polycarbonate, for example, GE's Lexan® polycarbonate, and combinations thereof, among other plastics. The tool restraint taught herein may be molded, sintered, machined and/or combinations thereof to form the required pieces to assemble the tool restraint components. Resilient pads may be made from any resilient material, for example, one of the plastics discussed above or from an elastomeric material, e.g., one or more of natural rubber, neoprene, ethylene-propylene rubber (EDM/EPDM), urethane, polyurethane, styrene-butadiene rubber (SBR), isoprene rubber (IR), butadiene rubber (BR); room-temperature vulcanizing (RTV) silicone rubber, and combinations thereof or their equivalent.

The present invention may also include magnetic surfaces that help to restrain the tools. For example, a wide variety of permanent magnets may be used with the present invention such as rare earth magnets, ceramic magnets, alnico magnets, which may be rigid, semi-rigid and flexible magnets. Flexible magnets are made by impregnating a flexible material such as neoprene rubber, vinyl, nitrile, nylon or a plastic with a material such as iron flakes having magnetic characteristics and will find use with the present invention.

Figure 1B:
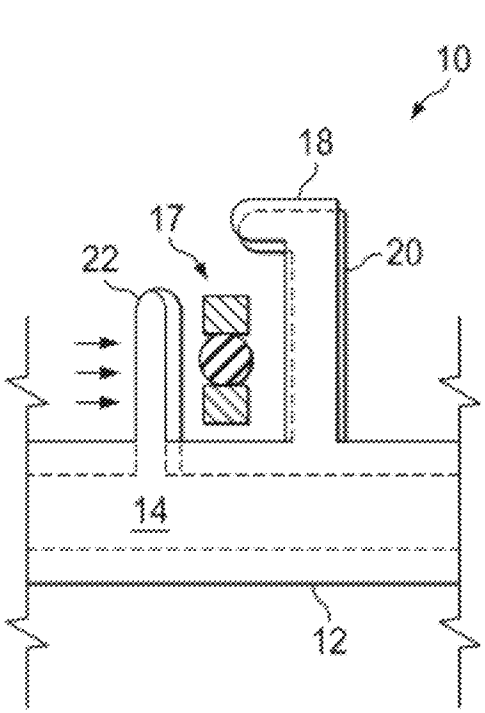
Figure 1A:
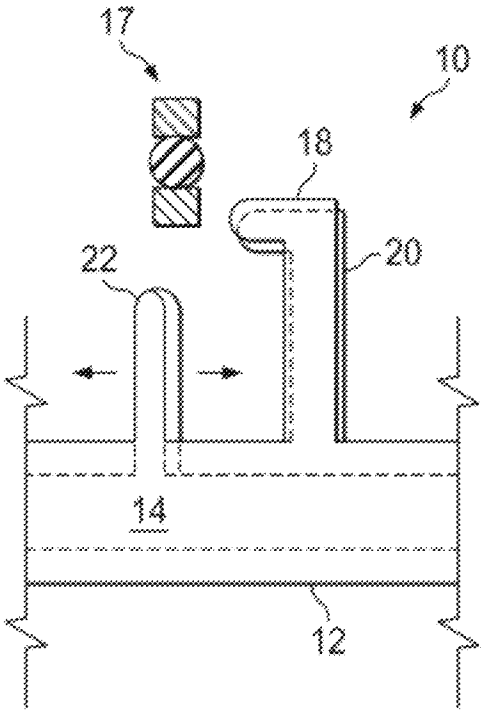

FIG. 1 illustrates three cross-sectional side views of a tool restraint 10. The tool restraint 10 includes a first base 12 with first restraints 18, 20 being slidably engaged with a second base 14 with a tool restraint 22 to hold a tool 17. In the first view (a), the first restraints 18, 20 and second restraint 22, are fully extended, so that a tool 17 may be inserted between first restraints 18, 20 and the second restraint 22. In the second view (b), the second restraint 22 has not made contact with the tool, but has partially engaged the tool by sliding the first base 12 in relation to the second base 14, in this diagram sliding the second restraint 22 towards first restraints 18, 20. In the third view (c), the second restraint 22, has slidably engaged the tool 17 because the tool 17 has made contact with either or both the second restraint 22 and the first restraints 18, 20 to provide a mechanical or other force to restrain the tool 17.

Figure 2:
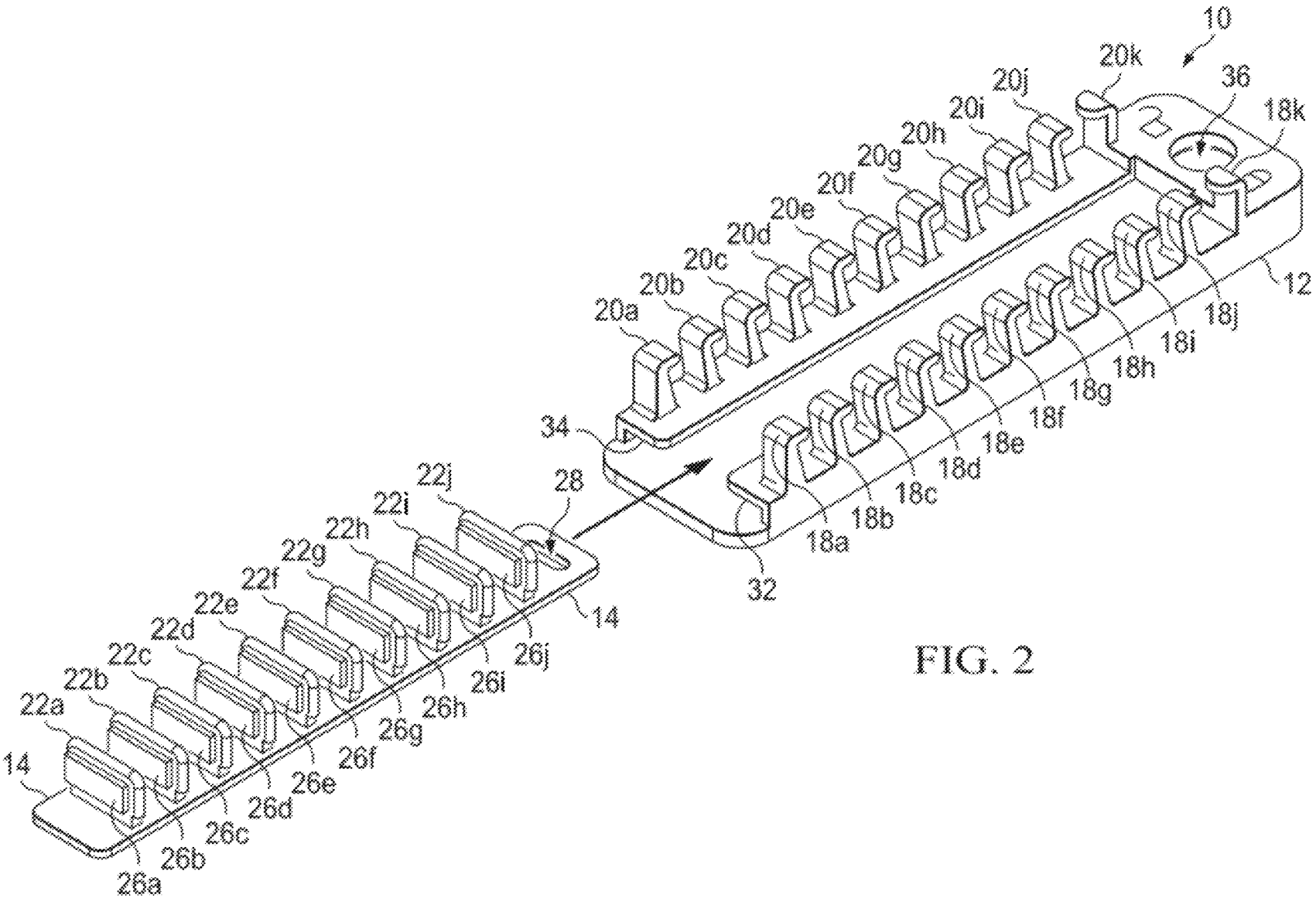
FIG. 2 illustrates an exploded isometric view of an embodiment of the tool holder.

FIG. 2 illustrates an exploded isometric view of an embodiment of the tool holder 10, comprising the first base 12, two or more first restraints 18*a-k*, 20*a-k* and a second base 14 movable within first base 12 with restraints 22*a-j* spaced apart from one another. This embodiment also depicts additional sets of two or more first restraints: 18*b*, 20*b*; 18*c*, 20*c*; 18*d*, 20*d*; and 18*e*, 20*e*; etc., aligned parallel to the base's longitudinal axis. Though scale is not indicated, the additional sets of two or more first restraints: 18*b*, 20*b*; 18*c*, 20*c*; 18*d*, 20*d*; and 18*e*, 20*e*; could be considered to be equidistantly spaced in relation to one another. While this embodiment allows two or more of first restraints 18, 20 to be considered as equidistantly spaced in relation to one another, the two or more first restraints 18, 20 may be arranged in any manner, with varying distance, with variable distances (i.e., the user can customize the distances) and with various heights.

Second base 14 is shown with one or more second movable restraints 22*a-j*, also depicted in this embodiment, spaced apart from one another, and capable of aligning with additional sets of two or more restraints 18*b*, 20*b*; 18*c*, 20*c*; 18*d*, 20*d*; and 18*e*, 20*e* to slidably engage a tool. Though this embodiment depicts the second movable restraints 22 as spaced apart from one another and capable of aligning with two or more first restraints 18, 20, the second movable restraints 22 do not necessarily have to be spaced apart from one another or capable of aligning with two or more first restraints 18, 20 in other embodiments. While this embodiment allows two or more of second restraints 22*a-j* to be considered as equidistantly spaced in relation to one another, the two or more second restraints 22*a-j* may be arranged in any manner, with varying distance, with variable distances (i.e., the user can customize the distances) and with various heights.

Attached to the second movable restraints 22*a-j* in this embodiment, are at least one pad 26*a-j*. While this particular embodiment depicts the additional pads 26*a*, 26*b*, 26*c*, 26*d*, and 26*e* attached to additional second movable restraints 22*a*, 22*b*, 22*c*, 22*d*, and 22*e*, other embodiments may not require this. For example, some additional second movable restraints 22*a*, 22*c* may have pads 26*a*, 26*c* attached while other additional second movable restraints 22*b*, 22*d*, and 22*e* may not have corresponding pads 26*b*, 26*d*, and 26*e*. The pads 26*a-j* may be removable and may be made from a wide variety of materials depending on the tool. For example, the pads 26*a-j* may be made from foam, rubber, plastic, wood, metal and may even be magnetic.

Furthermore, in this embodiment, the additional sets of two or more first restraints: 18*b*, 20*b*; 18*c*, 20*c*; 18*d*, 20*d*; and 18*e*, 20*e* as well as the additional second movable restraints 22*b*, 22*c*, 22*d*, and 22*e* could be considered as extending substantially perpendicular from the horizontal axis of the first base 12. Though this embodiment shows all additional sets of two or more first restraints: 18*b*, 20*b*; 18*c*, 20*c*; 18*d*, 20*d*; and 18*e*, 20*e* extending substantially perpendicular from the horizontal axis of the first base 12, in other embodiments some additional sets of two or more first restraints 18*b*, 20*b*; 18*c*, 20*c*, may extend substantially perpendicular from the horizontal axis of the first base 12, while other additional sets of two or more first restraints 18*d*, 20*d*; 18*e*, 20*e*, may extend at other angles from the horizontal axis the first base 12. Additionally while one first restraint 18 may extend substantially perpendicular from the horizontal axis of the first base 12, another first restraint 20, may extend at another angle from the horizontal axis of the first base 12.

Although this particular embodiment depicts a set of first restraints 18*a*, 20*a* as well as additional sets of first restraints 18*b*, 20*b*; 18*c*, 20*c*; 18*d*, 20*d*; and 18*e*, 20*e* aligned parallel from one another along the longitudinal axis of the first base 12, this need not necessarily be the case in other embodiments. For example, one set of first restraints 18*a*, 20*a* may be aligned parallel from one another, along the longitudinal axis of the first base 12, while an additional set of first restraints, 18*b*, 20*b*, also aligned parallel from one another, along the longitudinal axis of the first base 12, is staggered in relation to other sets of first restraints 18*a*, 20*a* and 18*c*, 20*c*. Furthermore other sets of first restraints 18*c*, 20*c*, may be aligned parallel from one another, along the longitudinal axis of the first base 12, yet be staggered in relation to other sets of first restraints 18*d*, 20*d*, 18*e*, 20*e*.

Moreover this particular embodiment depicts a first ridge 32 extending to form a cleave along the longitudinal axis of the first base 12 and a second ridge 34 extending to form a cleave along the longitudinal axis of the first base 12. While this embodiment depicts just one first ridge 32, additional first ridges 32 may also be formed along the longitudinal axis of the first base 12. Furthermore while this embodiment depicts just one second ridge 34, additional second ridges 34 may also be formed along the longitudinal axis of the base. For example, three independent first ridges 32 are plausible in one embodiment while eight independent second ridges 34 are plausible in another embodiment. Moreover the base may include at least one first ridge 32 without a corresponding second ridge 34 and the base may include at least one second ridge 34 without a corresponding first ridge 32.

Similarly, this particular embodiment depicts one aperture 36 extending through the vertical axis of the first base 12 to lockedly engage the second base 14; additional apertures 36 may be included in other embodiments. For example, three apertures 36 each extending vertically through the first base 12 is possible in other embodiments. Not depicted in this figure, a lock or locking mechanism may be inserted into the aperture 36.

Figure 3:
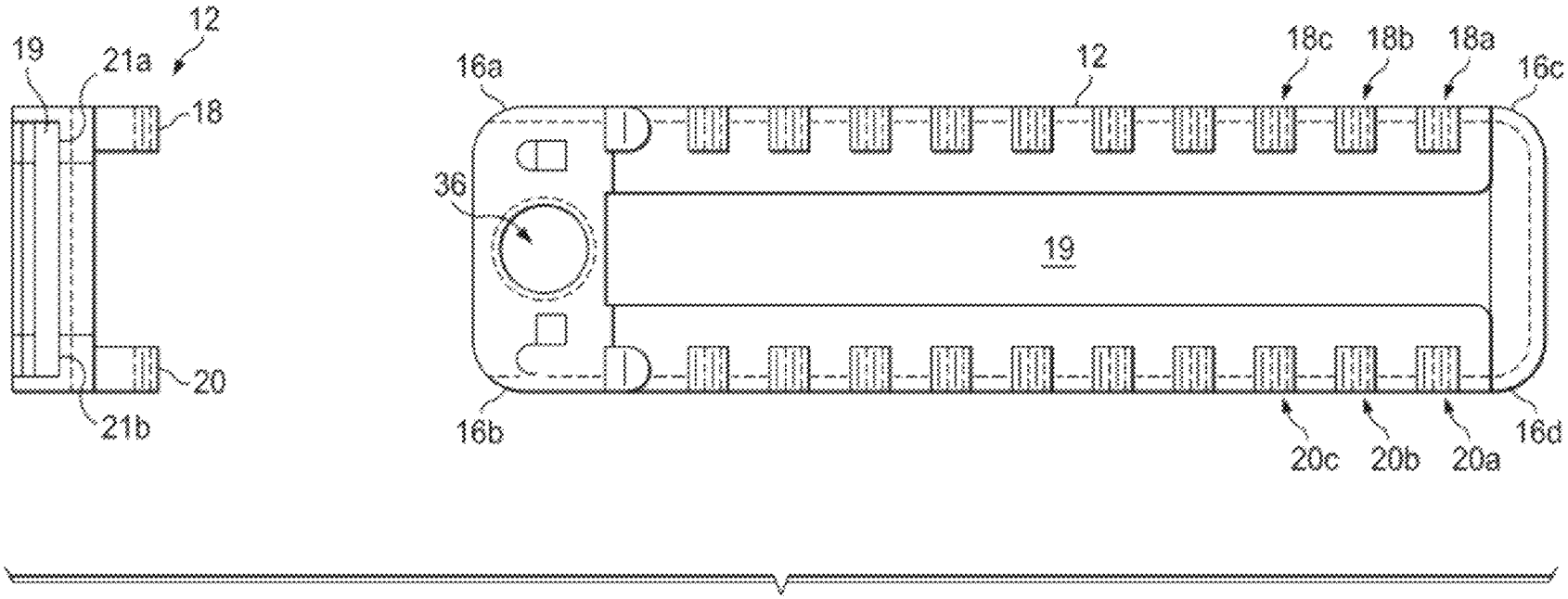
FIG. 3 depicts a top view of an embodiment the base containing first restraints.

FIG. 3 depicts a top view and end views of one embodiment the first base 12 having a slot 19 for the second base 14. In this figure, one or more first restraints 18*a*, 18*b*, and 18*c* are equidistantly spaced about the longitudinal axis of the first base 12 from other one or more first restraints, 20*a*, 20*b*, and 20*c*. Additionally one or more edges 16*a*, 16*b*, 16*c*, and 16*d* of the first base 12 may be rounded one as depicted in this embodiment or meet in a perpendicular fashion. In the side view, the slot 19 is depicted in which overhangs 21*a*, 21*b* are shown and in which the second base 14 is restrained while permitting the first base 12 and second base 14 to slide in relation to each other.

Figure 4:
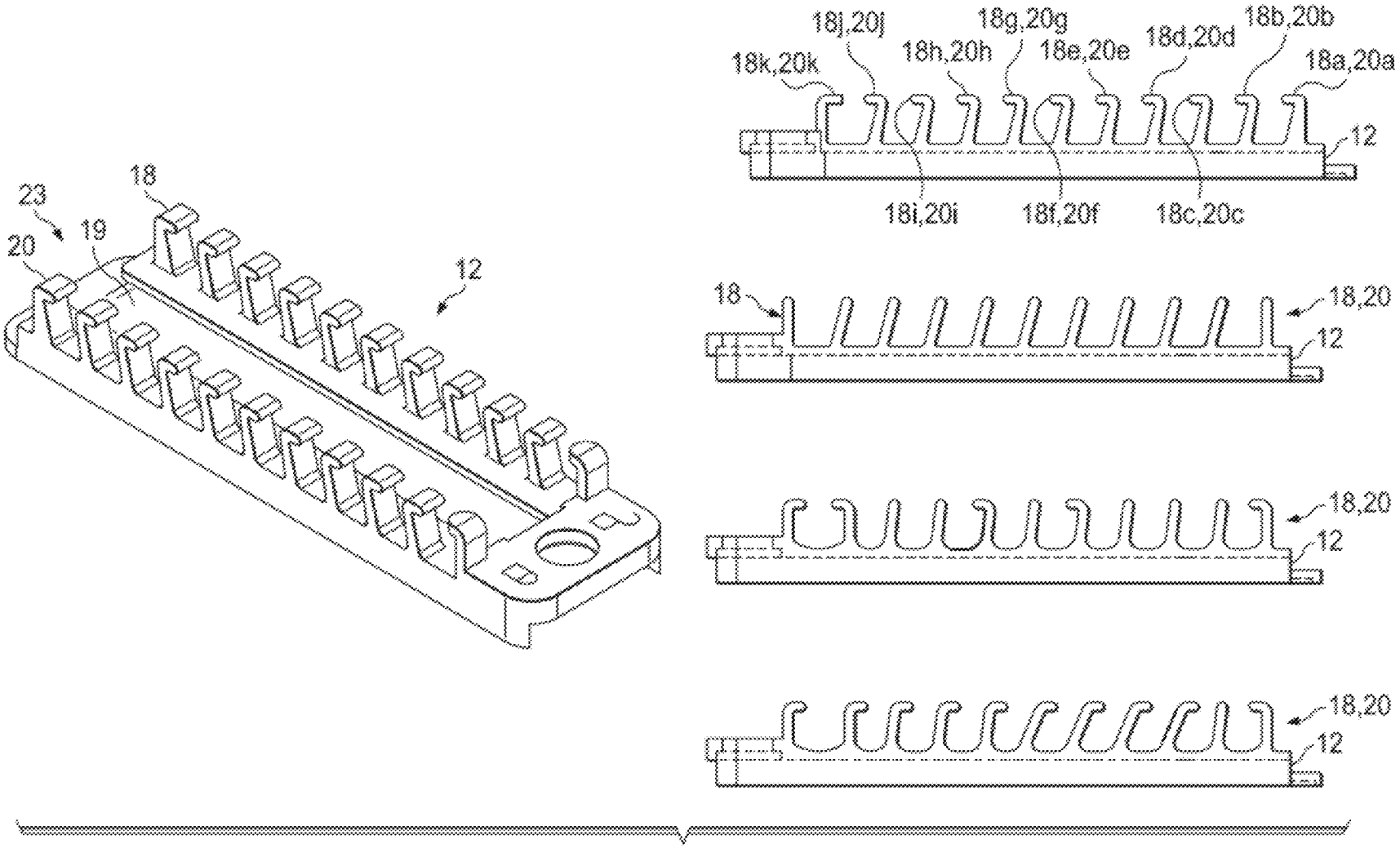
FIG. 4 depicts a side view of alternative embodiments of the base.

FIG. 4 depicts four side views of alternative embodiments of the first base 12 with a first restraint 18*a-k*. Though this list is not exhaustive any first restraint 20*a-k* may be formed as any other first restraint 18*a-k*. Any first restraint 18, 20 may be formed in a rounded fashion as depicted. Any first restraint 18*a-k*, 20*a-k* may be formed in a generally pointed direction. Any first restraint 18, 20 may be substantially perpendicular to the horizontal axis of the base as depicted. Any first restraint 18, 20 may form an angle with between 10 degrees and 150 degrees from the base's horizontal axis. Any first restraint 18, 20 may be spaced apart from additional first restraints 18*b*, 20*b* as depicted. Any first restraints 18, 20 may be placed closely to additional first restraints 18*b*, 20*b*. Furthermore, any of the first restraints 18*a-k*, 20*a-k* may have any shape formed therein to optimize tool engagement, for example, by changing the shape of the final closed position formed between first restraint(s) 18*a-k*, 20*a-k* and second restraint(s) 22*a-k*. The skilled artisan will recognize that the number of restraints may be varied to accommodate the required number of tools (not depicted). As seen in the isometric view, an insertion slot 23 is shown in which the second base (not shown) may be inserted, after which, the end may be blocked to prevent the second base (not shown) from being removed.

Figure 5:
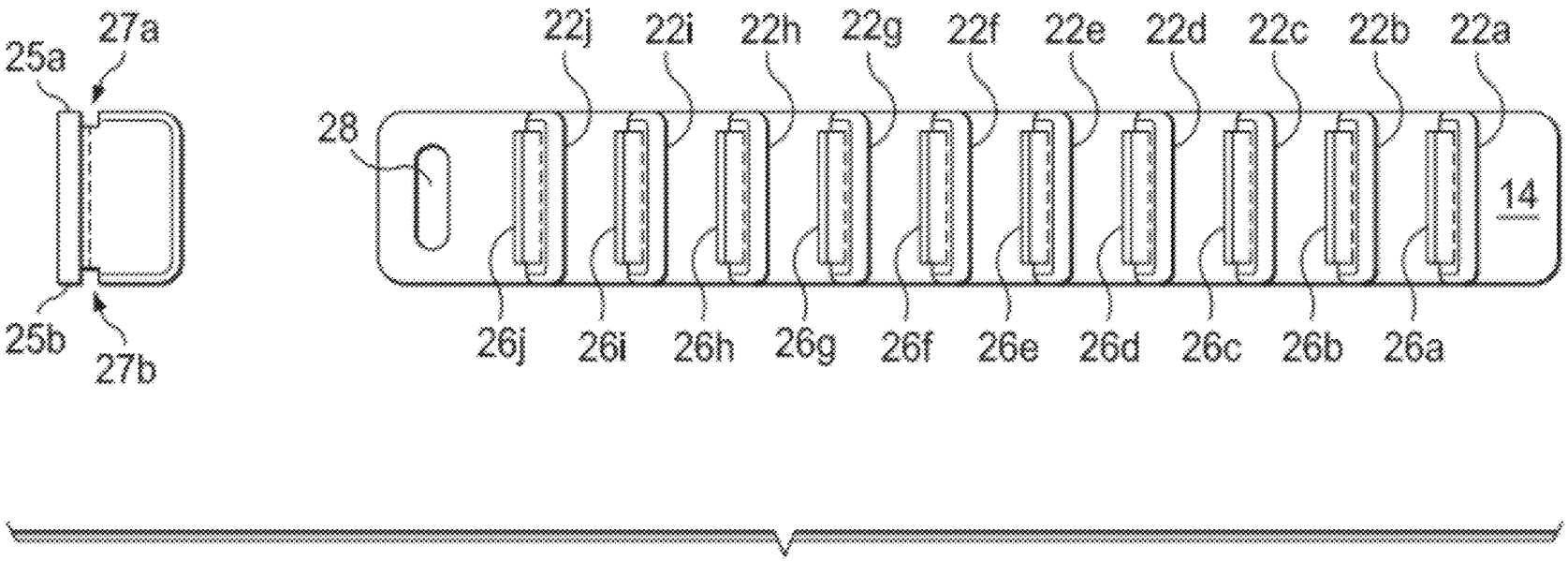
FIG. 5 depicts a top view of an embodiment of the base containing second movable restraints containing pads.

FIG. 5 depicts a top and side view of one embodiment of the second base 14 containing one aperture 28 and one or more second movable restraints 22*a-j* with pads 26*a-j* attached. Though pad 26*a* and additional pads 26*b*, 26*c*, and 26*d* are attached to all second movable restraints 22*a*, 22*b*, 22*c*, and 22*d* in this particular embodiment, other embodiments may include second movable restraints 22 with pads 26 and other second movable restraints 22 without pads. For example, one embodiment may include second movable restraints 22*a*, 22*d*, and 22*e* with pads 26*a*, 26*d*, and 26*e*, while other second movable restraints 22*b*, 22*c*, 22*f*, 22*g*, and 22*h* are without pads. As depicted in the side view, the second base 14 is generally shaped to insert into the slot 23 (see FIG. 4) and has lips 25*a*, 25*b* that permit the second base 14 to slide within slot 19 of the first base 12 at the overhangs 21, 21*b*. In this embodiment, cut-outs 27*a*, 27*b* are depicted that match the overhangs 21*a*, 21*b* of the first base 12, thereby maximizing the surface area of the second movable restraints 22*a-j*, while still permitting the slidable relationship between the first base 12 and the second base 14.

Figure 6:
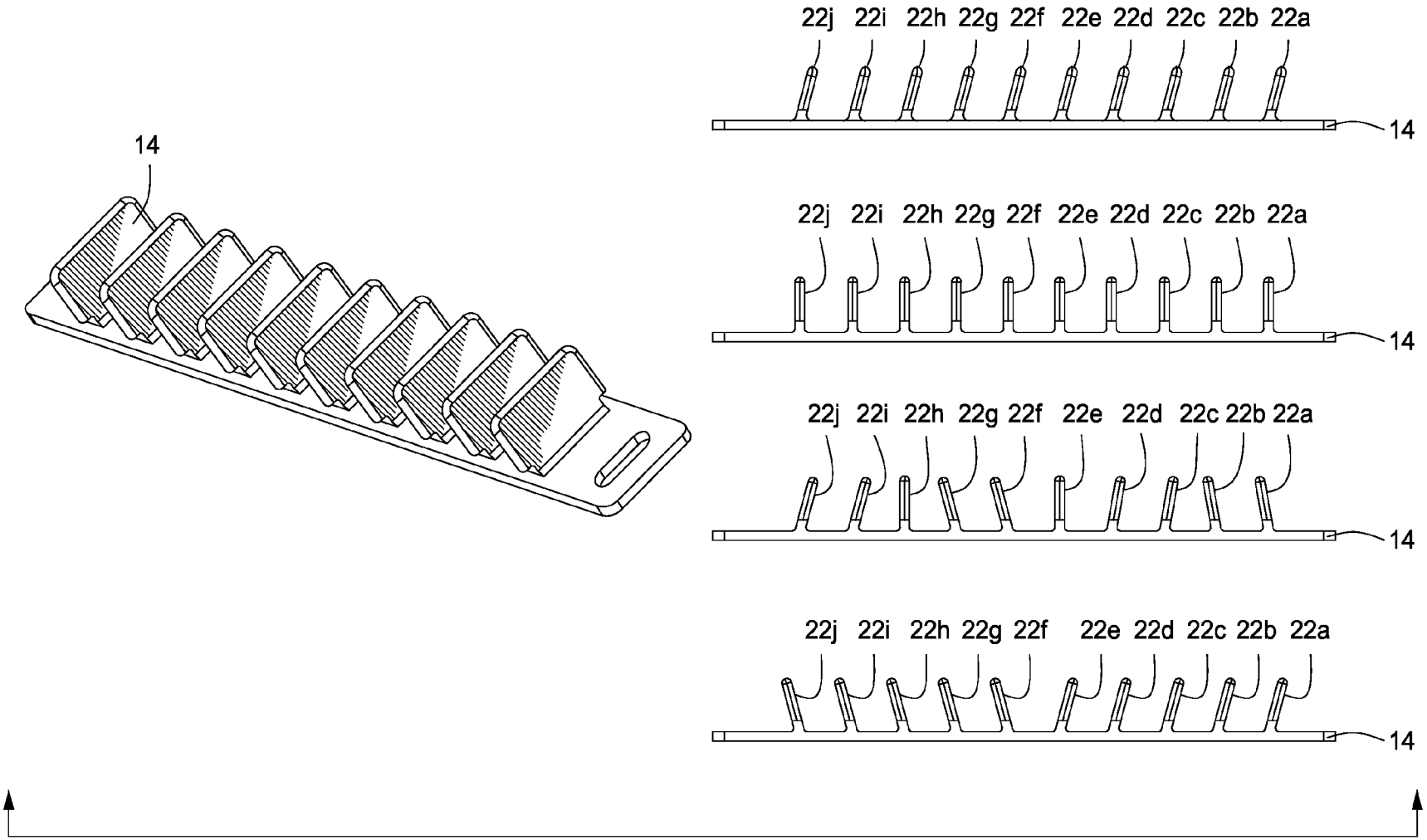
FIG. 6 depicts a side view of an embodiment of the base with one or more second movable restraints.

FIG. 6 depicts a side and isometric view of an embodiment of the second base 14 with one or more second movable restraints 22*a*, 22*b*, 22*c*, 22*d*, 22*e*, 22*f*, 22*g*, 22*h*, 22*i*, and 22*j*. Any second restraint 22 may be formed in a generally flat fashion as depicted. Any second restraint 22 may be formed in a generally rounded direction. Any second restraint 22 may be substantially perpendicular to the horizontal axis of the base as depicted. Any second restraint 22 may form an angle with between 30 degrees and 150 degrees from the base's horizontal axis. Any second restraint 22 may be spaced apart from additional second restraints 22*b*, 22*c* as depicted. Also any second restraint 22 may be placed closely to additional second restraints 22*b*, 22*c*. As with the first restraints 18, 20, the second restraint 22 may have any of a variety of shapes, sizes, angles and heights that may be customized or customizable by the user depending on the tool that the user seeks to restrain.

Figure 7:
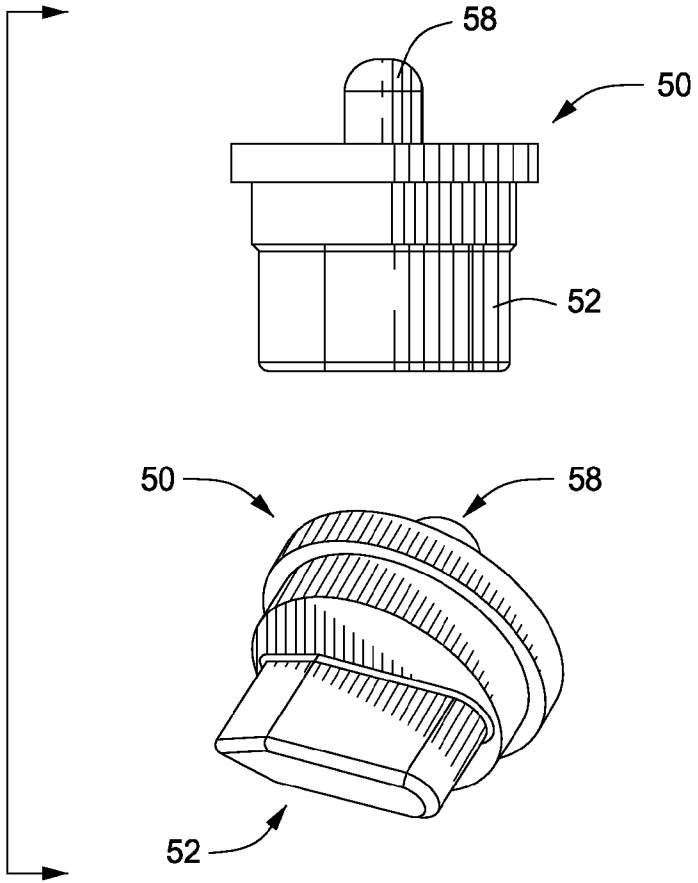
FIG. 7 depicts an isometric view of an embodiment of an optional locking mechanism.

FIG. 7 depicts an isometric and a side view of one embodiment of an optional locking mechanism 50, which may be inserted through an aperture 36 in the first base 12, to lockedly engage second movable restraints 22. The optional locking mechanism 50 may contain a knob 52, which when turned, moves an off-center bottom member 58 that fits within the aperture 28 of the second base 14 and which may provide both a sliding force to operate the tool restraint 10 as well as lock the tool restraint 10 with or without tools.

Figure 8:
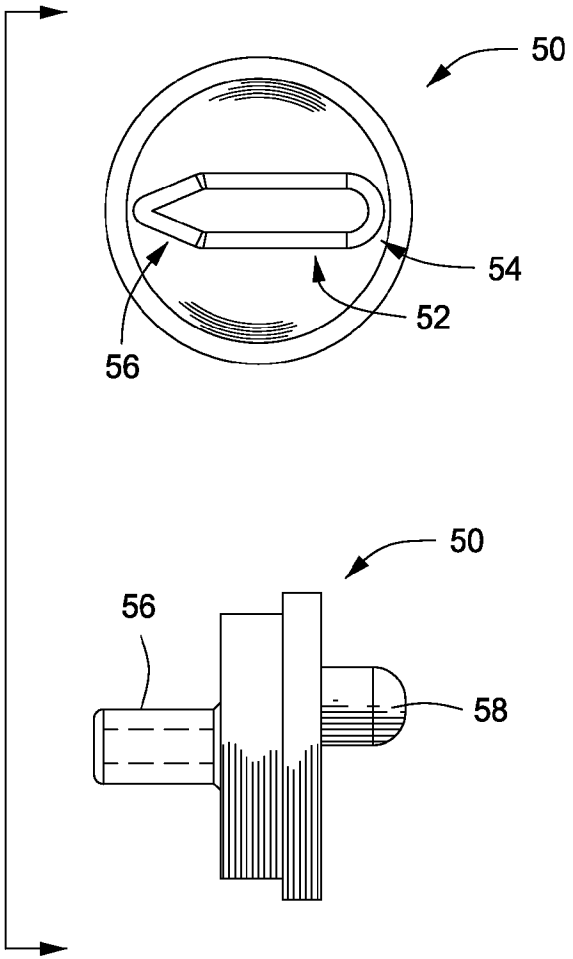
FIG. 8 depicts a top view of an embodiment of the optional locking mechanism.

FIG. 8 depicts a top view of an embodiment of the optional locking mechanism 50. As depicted, the knob 52 may contain a rounded edge 54 and a pointed edge 56. Alternatively, the knob 52 may includes two rounded edges 54, or may contain two pointed edges 56.

It will be understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific procedures described herein. Such equivalents are considered to be within the scope of this invention and are covered by the claims.

Figure 9:
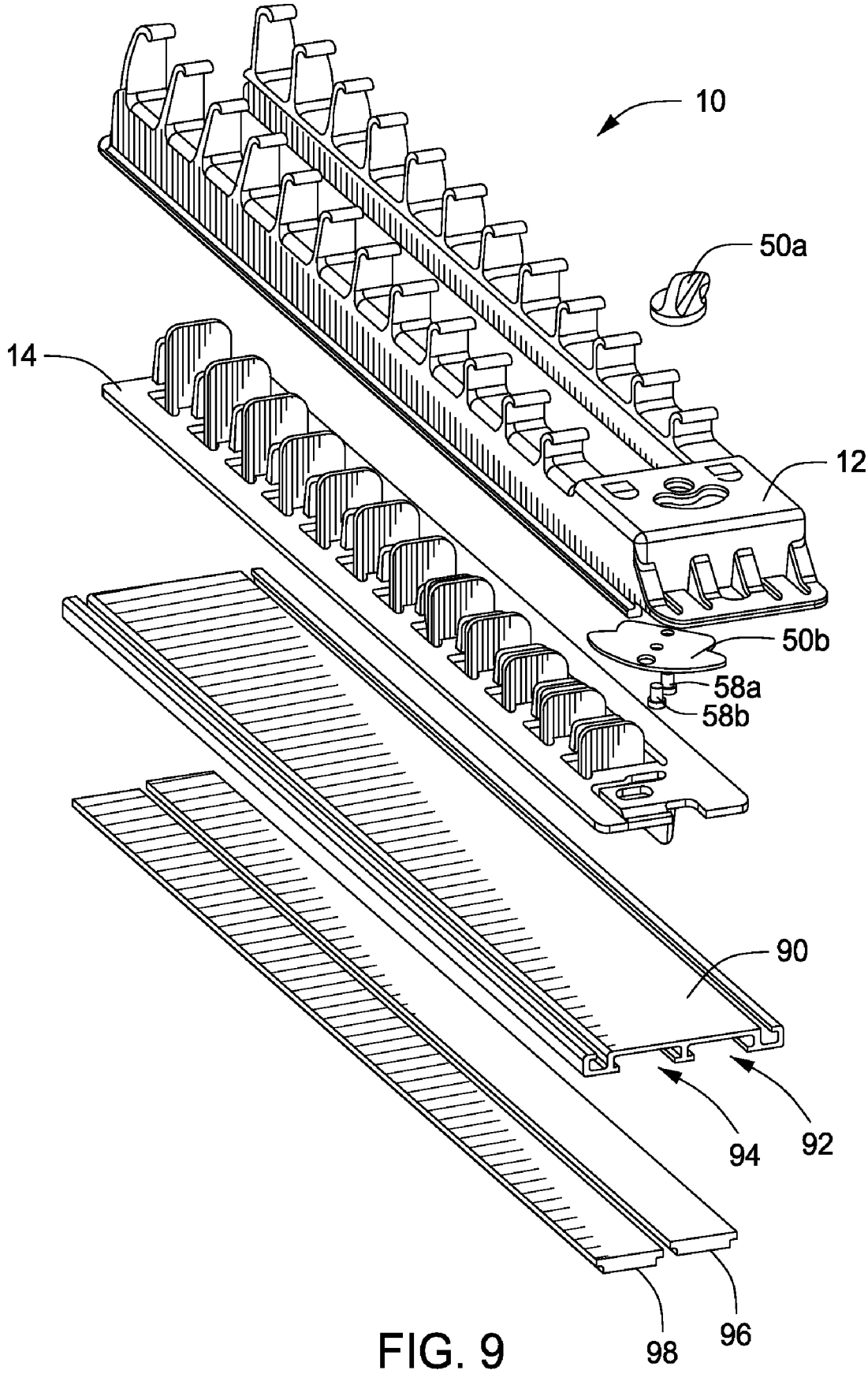
FIG. 9 depicts an exploded isometric view of another embodiment of the too holder.

FIG. 9 illustrates an exploded isometric view of another embodiment of the tool holder 10, comprising the first base 12 and a second base 14. This embodiment shows the change in height of the first and second restraints which are not equidistantly spaced in relation to one another, have a varying distance and height as well as a locking mechanism depicted in three parts, handle 50*a*, rotating base 50*b*, center rotation pin 58*a* and off-center pin 58*b*. An additional feature of this embodiment is that a third base 90 is depicted that has slots 92, 94 that may be provided to engage rails 96, 98. The rails 96, 98 may form part of an overall tool holding apparatus or tool storage system, which may be horizontal, vertical or diagonal. For example, the rails may be attached to a pegboard or fastened to a wall or storage unit. Alternatively, the rails may be magnetic.

Figure 10A:
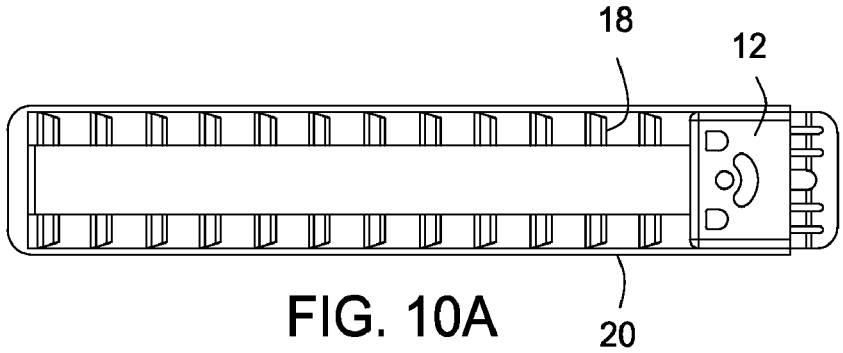
FIG. 10A through 10H depict perspective views of the first base and second base of the tool holder.
Figure 10B:
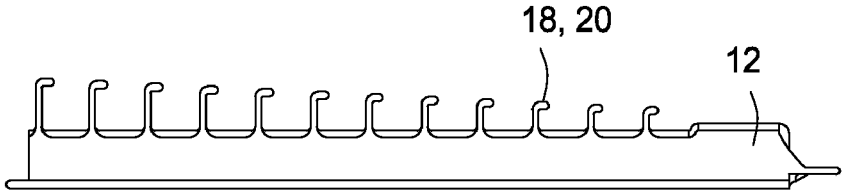
Figure 10C:
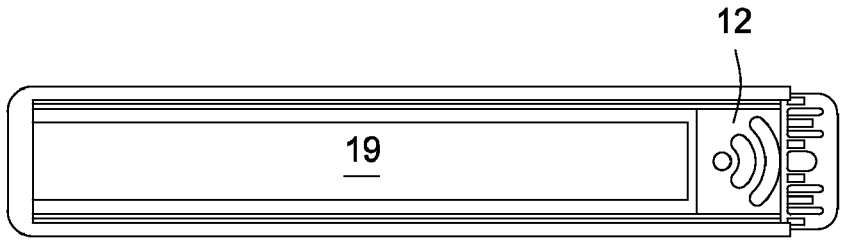
Figure 10D:
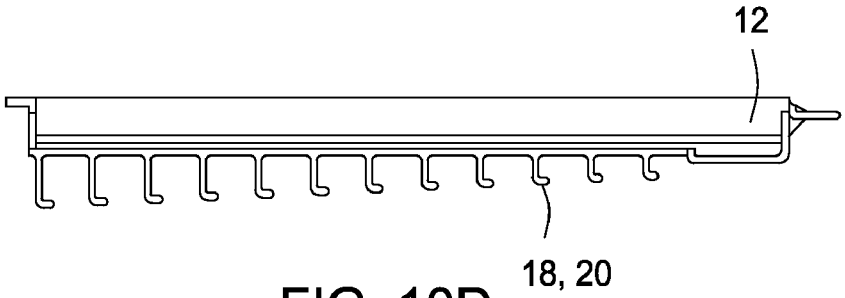
Figure 10E:
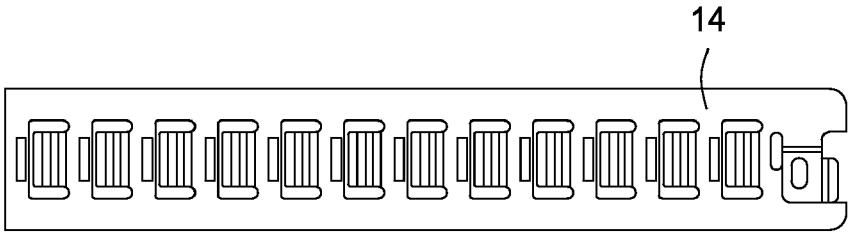
Figure 10F:
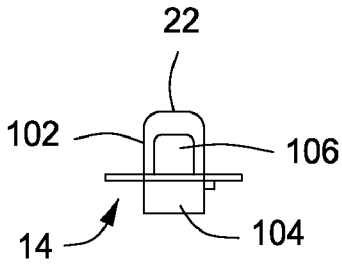
Figure 10G:
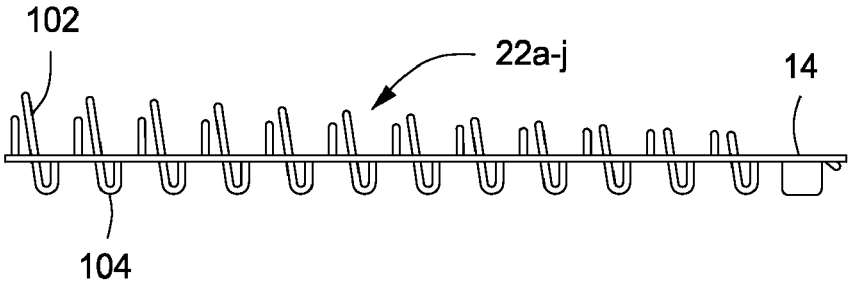
Figure 10H:
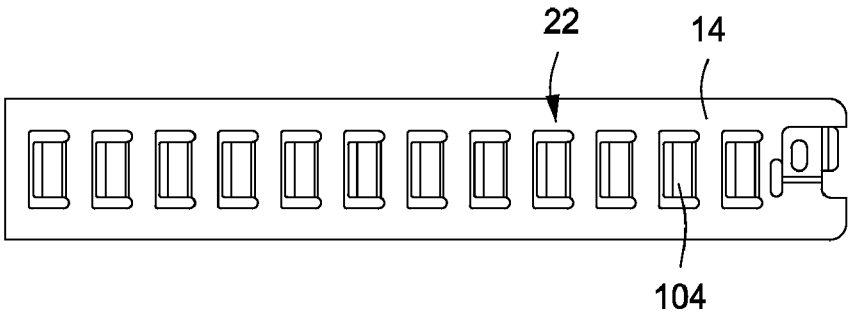

FIG. 10A-10H illustrates top views (FIGS. 10A, 10E), side views (FIGS. 10B, 10G), bottom views (FIGS. 10C, 10H), of the first and second bases (12, 14), respectively. Also depicted is a side view of the first base 12 (FIGS. 10B and 10D are contralateral views) and an end-on view of the second base (FIG. 10F). This embodiment shows the change in height of the first and second restraints which are not equidistantly spaced in relation to one another, have a varying distance and height for the first restraints 18, 20 as well as slot 19. In this embodiment, the second base 14 and the second restraints 22*a-j* are formed from a single piece and the restraints 22*a-j* are depicted as forming a "spring" to restrain the tool, which is best viewed in side view FIG. 10G and end view FIG. 10F. The second tool restraint 22 is depicted having a top portion 102 and a bottom portion 104. In FIG. 10F, the top portion is also shown with a pad 106. In FIG. 10G, the shape of the bottom portion 104 of the second tool restraint 22 is U-shaped and provides for flexibility for the second tool restraint 22 as it engages a tool (not depicted) when slid in relation to the first restraints 18, 20. Depending on the materials selected for the first and second bases (12, 14), the amount of flexibility and the method of manufacture can be selected. For example, if made from metal the flexibility of the first and second restraints will vary based on the material(s) of the metal, the thickness of the metal, whether the metal is solid, sintered, welded, stamped or machined. If made from a non-metallic material (e.g., plastic) the variability will also be based on the type of material(s), thickness, stamped or injection molded. In addition, combinations of metallic and non-metallic materials may be made.

The tools that may be held using the present invention include, but are not limited to hand tools, mechanic's tools, wrenches, screwdrivers, Allen wrenches, pliers, saws, knives, hammers, bits, taps, threading tools, augers, files, rasps, punches, chisels, snips, bolt-cutters, extensions (e.g., socket or bit extensions), power tool accessories and ratchets. The tools may be parts of sets of common tools, or combinations of different types of tools.

All publications and patent applications mentioned in the specification are indicative of the level of skill of those skilled in the art to which this invention pertains. All publications and patent applications are herein incorporated by reference to the same extent as if each individual publication or patent application was specifically and individually indicated to be incorporated by reference.

In the claims, all transitional phrases such as "comprising," "including," "carrying," "having," "containing," "involving," and the like are to be understood to be open-ended, i.e., to mean including but not limited to. Only the transitional phrases "consisting of" and "consisting essentially of," respectively, shall be closed or semi-closed transitional phrases.

All of the materials and/or methods disclosed and claimed herein can be made and executed without undue experimentation in light of the present disclosure. All such similar substitutes and modifications apparent to those skilled in the art are deemed to be within the spirit, scope and concept of the invention as defined by the appended claims.

What is claimed is:

1. A tool holder comprising a first base comprising at least one first restraint extending from the first base that is adapted to engage a first side of a tool and that is adapted to not engage a second side of the tool; and a second base that is adapted to slidably engage the first base, the second base comprising at least one second restraint extending from the second base that is adapted to slidably engage a second side of the tool when the tool is disposed between the first restraint and the second movable restraint wherein the tool is held only by the at least one first restraint and the at least one second movable restraint and wherein each of the first base and second base further comprises one or more apertures and a locking mechanism insertable into at least one aperture and the locking mechanism to lockedly engage the first and second bases.

2. The tool holder of claim 1, wherein the first base comprises two or more first restraints extending from the first base and wherein the second base comprises two or more second restraints extending from the second base.

3. The tool holder of claim 2, wherein the two or more first restraints differ in size from another first restraint to engage tools of different sizes or the two or more second restraints differ in size from other second restraints to engage tools of different sizes, or both.

4. The tool holder of claim 1, wherein the first restraints are aligned parallel to a longitudinal axis of the base and equidistant in relation to one another, non-equidistant in relation to each other or staggered in relation to one another.

5. The tool holder of claim 1, wherein the first, second or both restraints form an angle of between about 30 degrees and about 150 degrees from a horizontal axis of the base.

6. The tool holder of claim 1, wherein the first restraints are metallic, non-metallic, magnetic, non-magnetic, elastomeric, non-elastomeric, malleable, non-malleable and the one or more second restraints are metallic, non-metallic, magnetic, non-magnetic, elastomeric, non-elastomeric, malleable, non-malleable.

7. The tool holder of claim 1, wherein the first base is metallic, non-metallic, magnetic, non-magnetic, elastomeric, non-elastomeric, malleable, non-malleable or combinations thereof, and the second base is metallic, non-metallic, magnetic, non-magnetic, elastomeric, non-elastomeric, malleable, non-malleable or combinations thereof.

8. A method for holding one or more tools, comprising:

providing a first base having at least one first restraint extending from the first base that is adapted to engage a first side of a tool and that is adapted to not engage a second side of the tool and at least one second base comprising at least one second movable restraint extending from the second base that is adapted to slidably engage a second side of the tool;

slidably engaging the tool between the at least one first restraint and the at least one second movable restraint; and holding the tool only by the at least once first restraint and the at least one second movable restraint and wherein each of the first base and second base further comprises one or more apertures and the method further comprises the steps of inserting a locking mechanism into at least one aperture and rotating the locking mechanism to lockedly engage the first and second bases.

9. The method of claim 8, further comprising:

rotating the locking mechanism whereby allowing sliding between the base and a cam, wherein the rotation moves the first and second restraints in relation to each other, thereby engaging or disengaging a tool held thereby.

10. The method of claim 8, wherein the first base comprises two or more first restraints extending from the first base and wherein the second base comprises two or more second restraints extending from the second base.

11. The method of claim 10, wherein the two or more first restraints differ in size from another first restraint to engage tools of different sizes or the two or more second restraints differ in size from other second restraints to engage tools of different sizes, or both.

12. The method of claim 8, wherein the first restraints are aligned parallel to a longitudinal axis of the base and equidistant in relation to one another, non-equidistant in relation to each other or staggered in relation to one another.

13. The method of claim 8, wherein the first, second or both restraints form an angle of between about 30 degrees and about 150 degrees from a horizontal axis of the base.

14. The method of claim 8, wherein the first restraints are metallic, non\-metallic, magnetic, non-magnetic, elastomeric, non-elastomeric, malleable, non-malleable and the one or more second restraints are metallic, non-metallic, magnetic, non-magnetic, elastomeric, non-elastomeric, malleable, non-malleable or combinations thereof.

15. The method of claim 8, wherein the first base is metallic, non-metallic, magnetic, non-magnetic, elastomeric, non-elastomeric, malleable, non-malleable and the second base is metallic, non-metallic, magnetic, non-magnetic, elastomeric, non-elastomeric, malleable, non-malleable or combinations thereof.

16. A tool holder comprising:

a first base comprising two or more first restraints extending from the first base wherein the two or more first restraints are adapted to engage a first side of a tool and are adapted to not engage a second side of the tool; and a second base that is adapted to slidably engage the first base, the second base comprising one or more second restraints extending from the second base that are adapted to slidably engage a second side of the tool when the tool is disposed between a first restraint and a second restraint, wherein the first and second bases are adapted to slide in relation to each other and the first and second restraints are capable of mechanically holding a tool when the first and second restraints are brought into proximity, and wherein the tool is held only by the first and second restraints and wherein each of the first base and second base further comprises one or more apertures and a locking mechanism insertable into at least one aperture and the locking mechanism to lockedly engage the first and second bases.

17. The tool holder of claim 16, wherein the first restraint, second restraint or both the first and second restraints further comprise a pad.

18. The tool holder of claim 16, wherein the two or more first restraints differ in size from another first restraint to engage tools of different sizes or two or more second restraints differ in size from other second restraints to engage tools of different sizes, or both.

19. The tool holder of claim 16, wherein the first restraints are aligned parallel to a longitudinal axis of the base and equidistant in relation to one another, non-equidistant in relation to each other or staggered in relation to one another.

20. The tool holder of claim 16, wherein the first restraints are metallic, non-metallic, magnetic, non-magnetic, elastomeric, non-elastomeric, malleable, non-malleable and the one or more second restraints are metallic, non-metallic, magnetic, non-magnetic, elastomeric, non-elastomeric, malleable, non-malleable or combinations thereof.

21. The tool holder of claim 16, wherein the first base is metallic, non-metallic, magnetic, non-magnetic, elastomeric, non-elastomeric, malleable, non-malleable and the second base is metallic, non-metallic, magnetic, non-magnetic, elastomeric, non-elastomeric, malleable, non-malleable or combinations thereof.

* * * * *